US005325778A

United States Patent [19]

Hartung et al.

[11] Patent Number: 5,325,778

[45] Date of Patent: Jul. 5, 1994

[54] DEVICE FOR CLAMPING AND TENSIONING PRINTING PLATES

[75] Inventors: Georg Hartung, Seligenstadt; Helmut Schild, Steinbach/Taunus, both of Fed. Rep. of Germany

[73] Assignee: Man Roland Druckmaschinen AG, Fed. Rep. of Germany

[21] Appl. No.: 56,293

[22] Filed: Apr. 30, 1993

[30] Foreign Application Priority Data

Apr. 30, 1992 [DE] Fed. Rep. of Germany ..... 4214168

[51] Int. Cl.[5] ..... B41F 21/00

[52] U.S. Cl. ..... 101/415.1; 101/378

[58] Field of Search ..... 101/378, 415.1, 382.1, 101/383

[56] References Cited

U.S. PATENT DOCUMENTS 3,658,002 4/1972 Preuss ..... 101/415.1

FOREIGN PATENT DOCUMENTS 2092956 8/1982 United Kingdom ..... 101/415.1

*Primary Examiner*—Edgar S. Burr
*Assistant Examiner*—Ren Yan
*Attorney, Agent, or Firm*—Leydig, Voit & Mayer, Ltd.

[57] ABSTRACT

A clamping and tensioning rail for the trailing edge of a printing plate is mounted in the cylinder channel of a plate cylinder such that the trailing edge of the printing plate can be introduced in a simple way, without folding, into the gap between an upper and a lower clamping part. The clamping and tensioning rail is mounted pivotably about two pivot axes which are formed, for example, from stops fixed relatively to the cylinder and which interact respectively with an edge and an arcuate recess on the clamping and tensioning rail. Preferably, the clamping and tensioning rail is drawn into a completely open position by the force of a prestressed compression spring and can be pivoted against this force by an actuating shaft via lever arms and straps.

18 Claims, 5 Drawing Sheets

DEVICE FOR CLAMPING AND TENSIONING PRINTING PLATES

FIELD OF THE INVENTION

This invention relates generally to printing presses and more particularly to a device for clamping printing plates on the plate cylinder of printing machines such as sheet-fed offset printing machines.

BACKGROUND OF THE INVENTION

In sheet-fed offset printing machines, a printing plate having a leading edge—a print start—and a trailing edge—a print end—is typically fastened on the plate cylinder by means of tension rails arranged in a cylinder channel. These tension rails are assigned respectively to the print start and the print end. In order to attach a printing plate, the leading edge (print start) is first inserted and clamped into the corresponding tension rail. Next, the trailing edge (print end) is similarly clamped into a second tension rail. Finally, the printing plate is tensioned by the exertion of force. The accurate and precise introduction of the trailing edge of a new printing plate can be very time consuming under certain circumstances. In particular, the trailing edge must be precisely aligned when large format printing is involved. Thus, the design of the print-end tension rail is of great importance in reducing the time spent in drawing off an old printing plate and drawing on a new plate.

DE 3,940,795 C2, DE 3,940,796 C2 and EP 0,431,575 A2 disclose systems capable of performing automatic printing plate changes. In these systems, the drawing off of an old printing plate from the plate cylinder and the drawing on of a new printing plate onto the latter take place automatically. In addition to storage and reception regions for the printing plates, these systems also have transport devices for feeding a new printing plate and conveying an old printing plate away while the plate cylinder is being rotated in the appropriate direction. The printing plates are fastened onto the plate cylinder by means of tension rails which, as indicated in each of the individual publications, have remotely actuatable devices for corresponding clamping or tensioning.

EP 0,431,575 A2 discloses the use of printing plates having a bevel at their trailing edge (print end) which can be inserted into a radially oriented gap between two clamping pieces. After the printing plates are positioned, the two clamping pieces are pivoted in a virtually azimuthal direction by an eccentric shaft in order to achieve clamping, and ultimately, tensioning. This approach has many disadvantages. First of all, the new printing plates must be bevelled at their trailing edges by a special device. This bevelling must be carried out very carefully because possible corrugations in the bevelled region can lead to tilting and therefore to problems when introducing the plates into the gap of the tension rail. Therefore, the approach presents difficulties in manufacturing printing plates. Further, in view of the problems presented by corrugations, it seems scarcely possible to supply used printing plates for a system of this kind. Moreover, a bevelled print end cannot be conveyed directly by a transport system having a roller nip.

Bevelled printing plates cannot be used in the printing plate changing systems disclosed in DE 3,940,793 C2 and DE 3,940,796 C2 because of the specially designed print-end tension rails. The clamping flaps causing gripping have a specially arranged pivoting pole which is disclosed in DE 3,626,936 C1. These clamping flaps make it possible to place the trailing edge (print end) of the printing plate onto a lower clamping device. However, this procedure entails a relatively large pivoting angle of the clamping flap. A disadvantage of this large pivoting angle is that a clamping flap which is pivoted into the opening position projects correspondingly far from the reference-circle circumference of the print cylinder and thus impedes a pressure roller which causes the printing plate to be laid down.

German Utility Model 6,491,597 discloses a tension rail for use in a plate cylinder in a printing machine wherein the tension rail is assigned to the trailing edge or print end of a printing plate. This tension rail consists of two clamping pieces which are movable relative to one another for gripping the trailing edge of the printing plate. Further, in order to enable tensioning of the printing plate, the tension rail is pivotably mounted about an axis extending parallel to the plate cylinder. A disadvantage of the device described is that interaction with automatic plate changing systems is impossible.

U.S. Pat. No. 1,521,665, U.S. Pat. No. 3,107,609 and EP 0,458,323 A1 teach the tensioning of a printing plate with the force of compression springs. The printing plates can be released via a corresponding exertion of force counter to the spring forces.

OBJECTS OF THE INVENTION

It is a general object of the invention to provide an improved device for clamping printing plates onto the printing cylinder of printing machines. More specifically, it is an object of the invention to provide a device for clamping printing plates onto the printing cylinder of printing machines wherein a simple, precise and reliable introduction of the trailing edge of the printing plate into the corresponding tension rail is guaranteed during interaction with an automatic printing plate changing system.

SUMMARY OF THE INVENTION

The present invention accomplishes these objectives and overcomes the drawbacks of the prior art by providing a tension rail which is pivotable, depending on the pivoting position, about one of two axis extending parallel to the plate cylinder. The pivoting of the tension rail enables the attachment, tensioning and release of printing plates to and from the printing cylinder. Thus, in order to secure the printing plate to the printing cylinder, the trailing edge of the printing plate is inserted into the tension-rail gripping region (designed as a gap). This tension-rail gripping region follows a curved path having two radii of curvature into a position in which the printing plate is completely gripped. The clamping of the printing plate then takes place as a result of the closing of the gap, in that the lower and the upper clamping parts are braced relative to one another or, where a self-locking clamping device is concerned, after the closing of the gap and during a first phase of the tensioning of the printing plate.

After the plate end is gripped, the printing plate is tensioned by pivoting the gripping region of the tension rail about that axis which produces the small pivoting radius of the gap. This pivoting movement is continued until the necessary pull is exerted on the trailing edge of the printing plate.

Pivoting the tension rail about the two axes described above, results on the one hand in an optimum, slightly curved path of the gap for gripping the printing-plate end (large pivoting radius) and, on the other hand, in an optimum, force-transmitting lever effect (small pivoting radius) for tensioning the printing plate.

The gap can thus be pivoted over a large distance for gripping the printing-plate end without one or more springs (spring force to be stored by an actuating element) exerting the tensioning force. This prevents the printing plate from having to be greatly over-compressed.

According to an important aspect of the invention, the tension rail considerably simplifies the drawing on of a new printing plate. Since the trailing edge of the printing plate is gripped as a result of the above-described pivoting movement of the tension rail, it does not have to be specifically introduced into the tension-rail gripping region. The printing plate (which is fastened to the plate cylinder at the leading edge and drawn on according to its length around the circumference of the latter) need only be laid down flat in the region of the trailing edge (print end), so that the subsequent pivoting of the tension rail guarantees that the trailing end of the printing plate will be gripped reliably. The laying down of the trailing edge of the printing plate can take place by hand or by other means. When the tension rail according to the invention is used in conjunction with an automatic printing-plate changing system, this other means can comprise a corresponding pressure roller. In the latter instance, the pressure roller is applied to the plate cylinder with a specific force and the plate cylinder is then rotated into an appropriate position. When a pressure roller is employed, the pivoting of the tension rail guarantees a reliable gripping of the printing plate even when there is a possible corrugation of the printing-plate end (for instance when previously used printing plates are being employed).

In accordance with another aspect of the invention, the present invention includes at least one spring whose force is used for tensioning the printing plate. This spring is preferably a compression spring. However, other spring means, such as torsion bars or leaf springs, can also be employed. The compression spring is preferably fixedly supported at one end on the cylinder and is articulated at its other end on the upper clamping piece of the tension rail. Appropriate pre-stressing of the spring is achieved by means of a pull rod. The compression spring is preferably articulated and prestressed such that the tension rail is normally pivoted into an open position.

Thus, in order to pivot the tension rail out of the completely open position, (for instance, to grip a laid-down printing plate), the tension rail must be moved forward counter to the spring force. An actuating means comprising an actuating shaft is provided for this purpose. This actuating shaft is arranged in an elongated cylinder channel and extends parallel to the cylinder axis. The actuating shaft is articulated on the upper clamping piece of the tension rail, for example via a lever arm and a strap, in the manner of a toggle mechanism to effect the pivoting of the tension rail.

Furthermore, according to the invention, the tension rail, which is preferably arranged in the elongated cylinder channel, can be subdivided into a plurality of identical portions with each portion being mounted pivotably in the way described above. Thus, each portion can be provided with respective spring means to enable tensioning. The tensioning force is thus exerted on the printing-plate end in portions, so that, precisely where a large printing-plate format is concerned, automatic alignment is possible and, for example, register corrections can be made by varying the position of a front tension rail.

The spring means assigned to the individual portions can be correspondingly prestressed for register corrections. An asymmetric or one-sided distortion of the printing plate in the circumferential direction can thereby be brought about deliberately.

Subdividing the tension rail into portions provides a modular system, and therefore plate cylinders can be equipped with an appropriate number of portions according to the printing-plate format to be provided. For example, for the 3B format, seven identical portions of the tension rail can be provided. Both an actuating shaft and a clamping shaft is provided for the identically designed tension-rail portions as a whole. Both of these shafts are guided through all of the portions. The common actuating shaft acts on the individual portions via a corresponding number of lever arms and straps. The rotation of the common clamping and actuating shaft can take place by means of motors, for example compressed-air motors, arranged in the plate cylinder. In the alternative, one or more actuating devices can be arranged fixedly on the stand of the printing machine, such that, for a specific positioning of the plate cylinder, the devices act on the shafts via couplings or lever arms.

These and other features and advantages of the invention will be more readily apparent upon reading the following description of the preferred embodiment of the invention and upon reference to the accompanying drawings wherein:

DESCRIPTION OF A PREFERRED EMBODIMENT

Figure 1:
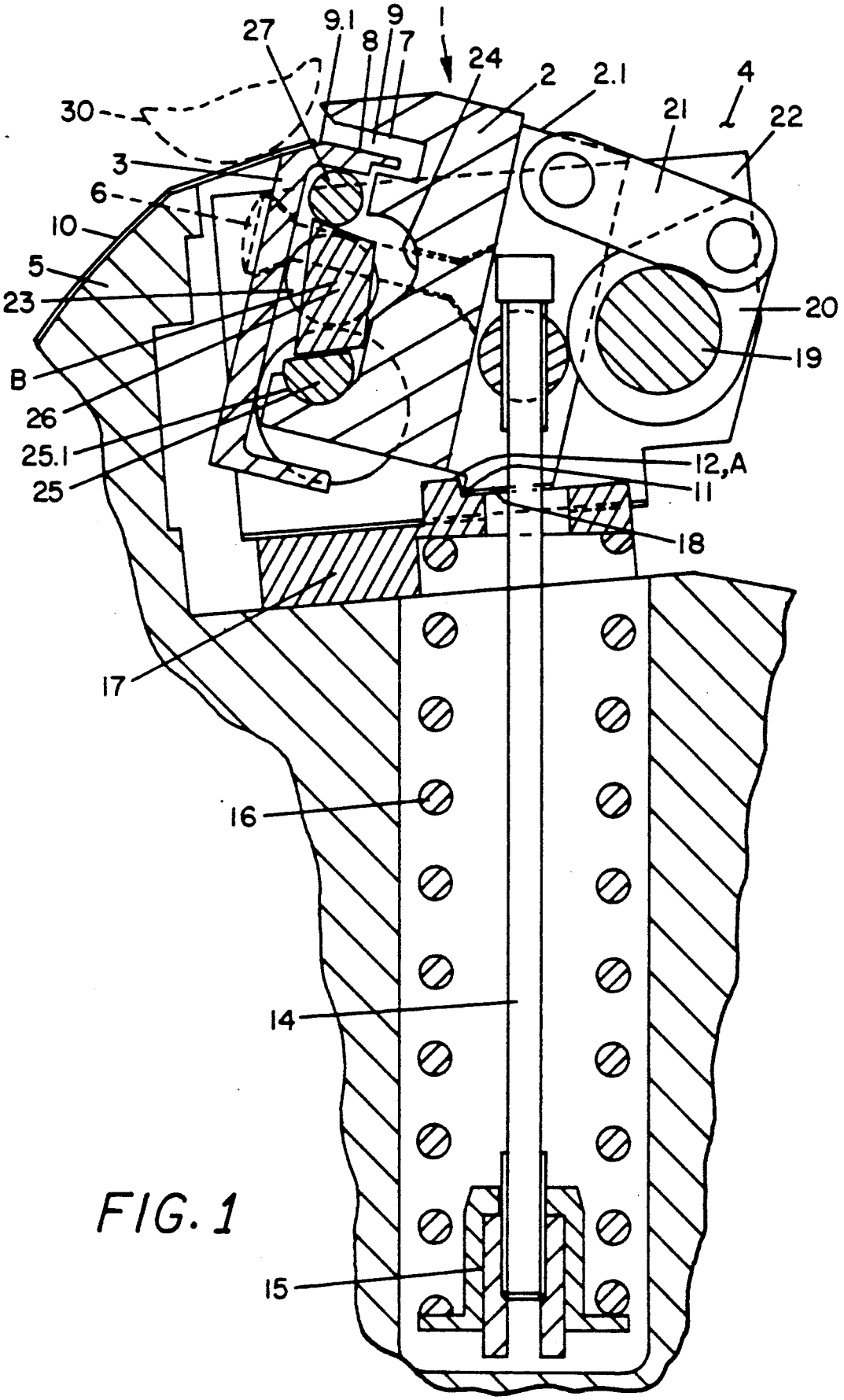
FIG. 1 is a cross-sectional view of a first version of the tension rail shown in profile.
Figure 2:
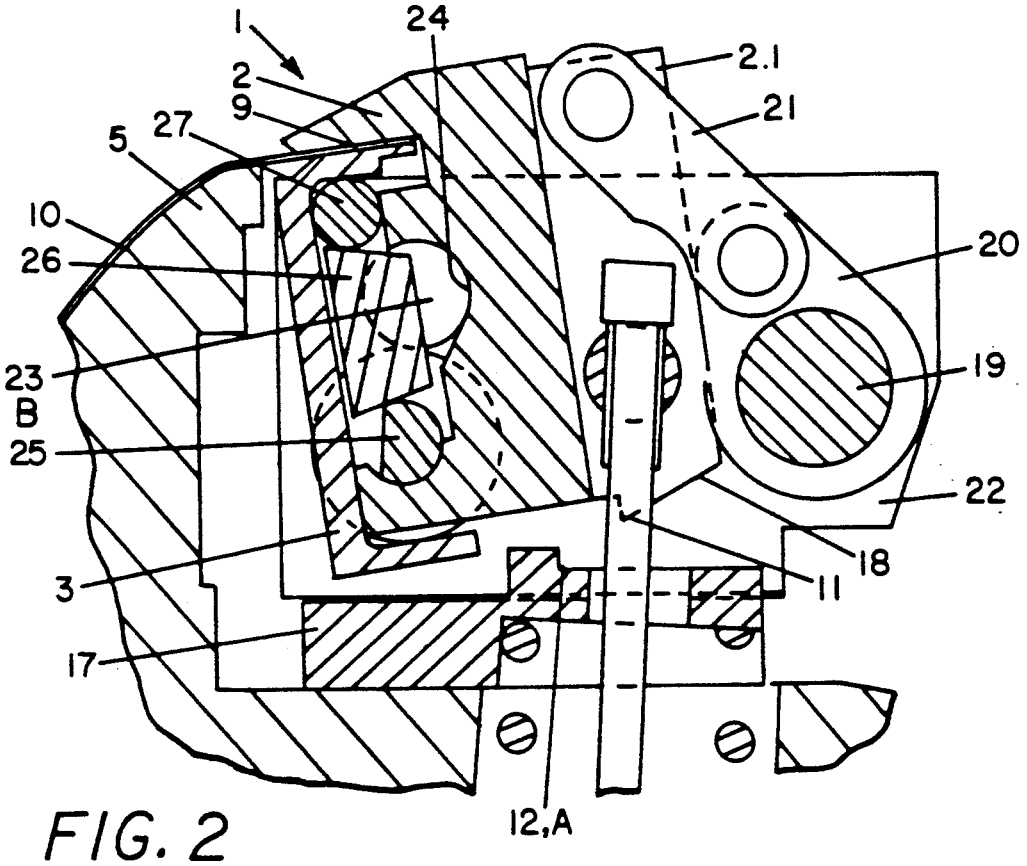
FIG. 2 is a partial cross-sectional view thereof showing the tension rail in a second position.
Figure 3:
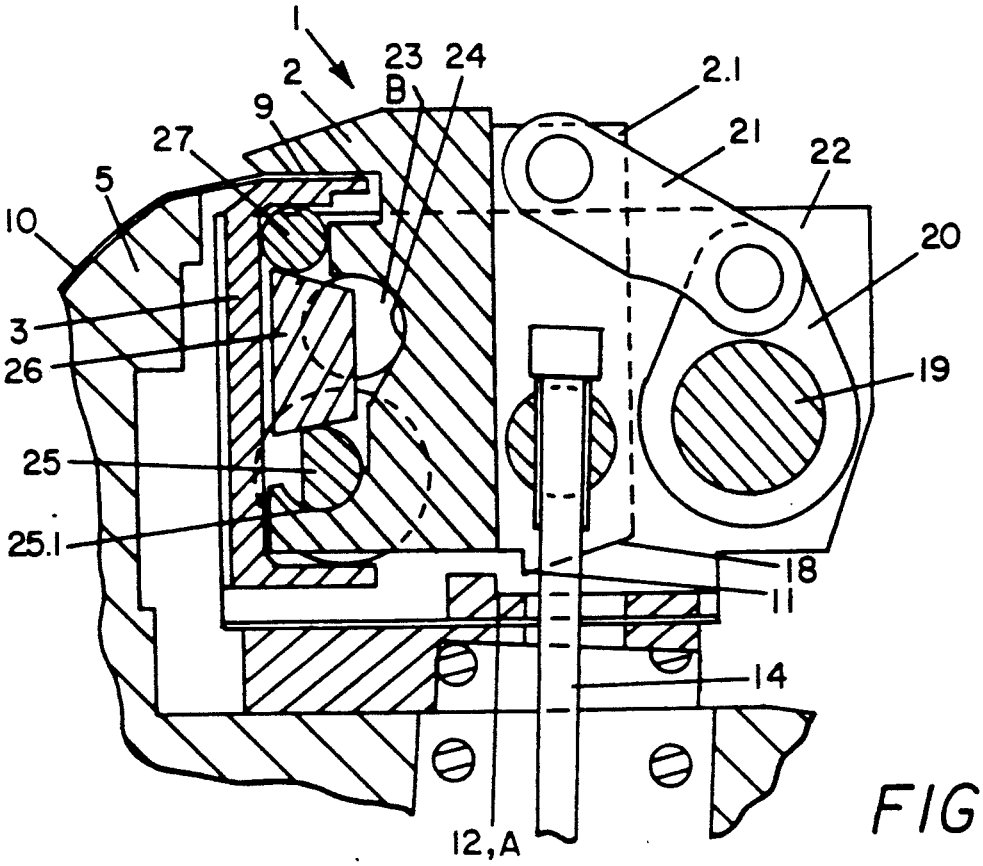
FIG. 3 is a partial cross-sectional view thereof showing the tension rail in a third position.

As can be seen in FIGS. 1-3, the tension rail 1 consists of an upper and a lower clamping part 2, 3 which are arranged pivotably in the elongated cylinder channel 4 of the plate cylinder 5. The upper clamping part 2 has the profile shown. The lower clamping part 3 has essentially a U-shaped profile and is connected to the upper clamping part 2, for example by means of one or more holding screws 6, in such a way that the lower clamping part 3 is displaceable relative to the lower clamping piece 2 in the drawing plane. This moveability can be achieved, for example, by means of the spherical head of the holding screw 6 and by corresponding dimensioning of bores in the clamping parts 2, 3 (as represented by broken lines in FIG. 1). The upper outer flank of the lower clamping part 3 and a straight face of the upper clamping part 2 form opposed clamping faces 7, 8 forming the gap 9. As a result of the above-described displaceability of the lower clamping piece 3 relative to the upper clamping piece 2, the trailing edge or print end of a printing plate 10 introduced into the gap 9 can be gripped or clamped by means of the opposed clamping faces 7, 8.

The upper clamping part 2 has an edge 11 in a side facing the bottom of the cylinder channel 4 which is arranged approximately diametrically to the position of the corresponding clamping face 7. This edge 11 is assigned a stop 12 which comprises a longitudinally extending step arranged fixedly relative to the cylinder on the bottom of the cylinder channel 4 and against which the edge 11 of the upper clamping part 2 bears in the position shown in FIG. 1. The upper clamping piece 2 together with the lower clamping piece 3 is therefore pivotable in a specific angular range about a first pivot axis A formed by the edge 11 and by the stop 12 fixed relative to the cylinder. In this case, the pivoting radius of the gap 9 corresponds approximately to the distance of the clamping face 7 from the edge 11.

Figure 4:
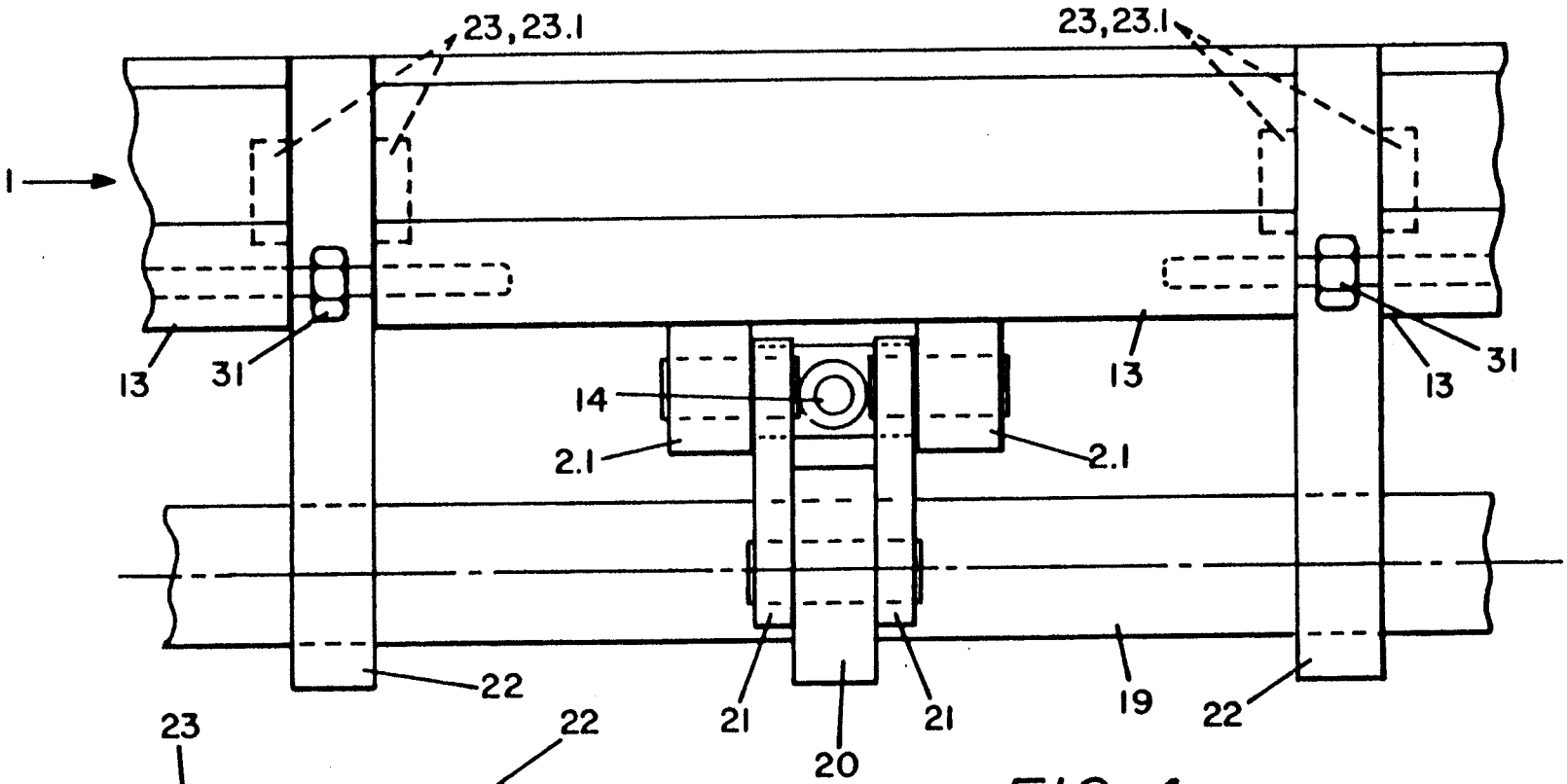
FIG. 4 is a top view thereof.

As is evident from FIG. 4, the length of the tension rail 1 is subdivided into a plurality of identical portions 13 each having a section as shown in FIGS. 1 to 3. One end of a pull rod 14, which is oriented in the direction of the cylinder body, is articulated on the upper clamping piece 2 in each portion 13 of the tension rail 1. The other end of the pull rod 14 engages a prestressed compression spring 16, for example via a washer 15 having a corresponding thread (FIG. 1). The compression spring 16 extends essentially coaxially relative to the pull rod 14. This compression spring 16 is supported by, and is fixed relative to, the cylinder on a baseplate 17 which is attached to the bottom of the cylinder channel 4, for example by means of screws. The bottom of the cylinder channel 4 also carries the stop 12. The pre-stressing force of the compression spring 16 can be adjustable via threads on the pull rod 14 and the washer 15. A supporting face 18 is arranged next to the edge 11 on the upper clamping part 2. The upper clamping part 2 is supported on the baseplate 17 such that it abuts supporting face 18 as shown in FIG. 1. The upper clamping piece is held in this position by the force of the compression spring 16. This position is exactly that in which the tension rail 1 is completely open, and is thus defined by the angle of the supporting face 18 relative to the clamping face 7.

An actuating means preferably comprising an actuating shaft 19 which is mounted in the cylinder channel 4 and which, as shown in FIGS. 1 to 4, is articulated in each portion 13 on the clamping parts 2 via a lever arm 20 and a strap 21 extends parallel to the axis of the plate cylinder 5. As best seen in FIG. 4, this articulation takes place via two webs 2.1 which are attached to the rear side of the upper clamping piece 2 and which, as shown in FIGS. 1 to 3, have the edge 11 of the pivot axis A and the supporting face 18. Thus, each upper clamping part 2 of a portion 13, and therefore, the tension rail 1 as a whole can be pivoted counter to the force of the compression spring 16 by the rotation of the actuating shaft 19.

Figure 5:
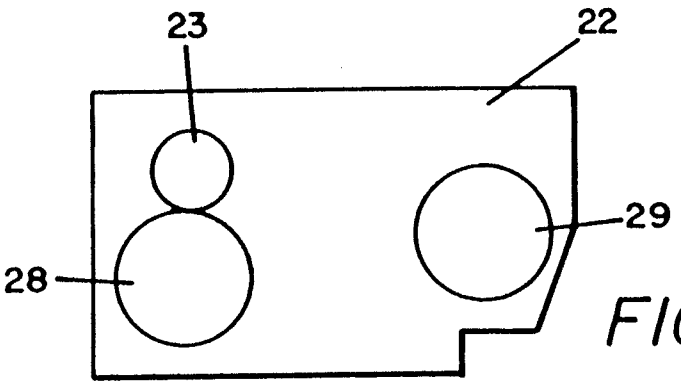
FIG. 5 is an elevational view of a bearing plate of a tension-rail portion.

As is evident in FIG. 4, each portion 13 of the tension rail 1 is assigned a bearing plate 22 on both sides which is shown once again, reduced, in FIG. 5. Each bearing plate 22 has a stop 23 on both sides. This stop 23 forms a second pivot axis B and takes the form of a cylindrical pin 23, 23.1 about which the upper clamping piece 2 is pivotable counter to the force of the compression spring 16. The last bearing plates 22 on a tension rail 1 have only one pin 23.1 which is located on the side on which a portion 13 of the tension rail 1 is also located.

As can be seen in FIGS. 1–3, the upper clamping part 2 has an arcuate recess or contour 24 which corresponds in dimensioning to that of the pin 23, 23.1. This contour 24 is located in approximately the clamping piece's middle profile region. The arcuate recess 24 is formed at both ends of a portion 13 in the upper clamping piece 2 in such a way that, after sufficient pivoting of the upper clamping piece 2 about the pivot axis A of the edge 11 or stop 12, the contour 24 bears against the pins 23, 23.1 of the bearing plates 22 at a specific pivoting angle. Thus, when the rotation of the actuating shaft 19 continues, the upper clamping piece 2 pivots about an axis formed by the pins 23, 23.1. In this second pivoting phase, the edge 11 lifts off from the longitudinally extending step 12. The pivoting radius of the gap 9 thus corresponds essentially to the distance of the clamping face 7 from the axis of the pin 23, 23.1 and is smaller than that of the first pivoting angle. In this second pivoting phase, the tension rail 1 can be pivoted into the position shown in FIG. 2 via the actuating shaft 19. The end position of this pivoting angle is obtained either by means of a mechanical stop or as a result of the extended position of the toggle mechanism 20, 21.

The lower clamping part 3 is displaceable relative to the upper clamping piece 2 via a clamp actuating means preferably comprising a clamping shaft 25 which can be applied to the clamping face 7 with force to open or close the gap 9. The clamping shaft 25 has a cylindrical profile with a flattened side and is inserted in a correspondingly profiled recess 25.1 in a lower part of the upper clamping piece 2. Adjacent to the clamping shaft 25 is a strip 26 with trapezoidal profile which has one or more bores (not shown) for the passage of the holding screws 6. The upper face of the strip 26 interacts with a roller 27 and an inner face of the lower clamping piece 3 in the manner of an inclined plane. By appropriate dimensioning of the play of the holding screw 6 and spring means (possibly to be provided but not shown), the lower clamping piece 3 can additionally execute a movement in the direction of the opposed clamping faces 7, 8. A pull exerted on the lower clamping part 3 in the gripping region 9 (during the tensioning of the printing plate 10) thus causes the clamping force to be generated or intensified by means of the strip 26 and the roller 27. The gripping region 9 can then be opened by rotating the clamping shaft 25. The lower clamping piece 3 can be returned into an initial position again by spring means (now shown). Complete portions 13 of the tension rail 1 or of the upper clamping pieces 2 are actuated by an especially continuous clamping shaft 25 (FIG. 4). Any deviations in pivoting position of the individual portions 13 relative to one another can be compensated in the longitudinal direction by the clamping shaft 25 as a result of corresponding deformations. However, the clamping shaft 25 can also be provided with compensating couplings between the portions 13 in the region of the bearing plates 22.

The bearing plates 22 provided between the individual portions 13 also have two bores 28, 29 in addition to the pins 23, 23.1. One of these bores 28 receives the clamping shaft 25 and is dimensioned according to the possible pivoting position. The other bore 29 can be used, for example, to mount the actuating shaft 19 at intervals (FIGS. 4 and 5). As shown in FIG. 4, two respective adjacent portions 13 of the tension rail 1 are each connected to a threaded spindle 31 in the region above their bearing plates 22. In the described embodiment, this threaded spindle 21 is designed as a hexagon in its middle region and has a right-hand and a left-hand thread respectively at its two ends. These ends of the threaded spindle 31 are screwed into movable blocks (not shown) in the respective portion 13, so that the portions 13 can be braced relative to one another transversely to the printing direction for narrower or wider printing. Furthermore, the movable articulation (not shown) of the threaded spindles 31 in the portions 13 guarantees that the portions 13 can come into alignment with one another during the tensioning of the printing plate.

The following is a functional description of the introduction and tensioning of a printing plate. The description refers to FIGS. 1 to 3.

As can be seen in FIG. 1, the printing plate 10 is first drawn completely onto the plate cylinder 5 as a result of the rotation of the latter, and the trailing edge of the printing plate 10 is laid down in the region of the tension rail 1 which is pivoted into the completely open position. The trailing edge can be laid down, for example, by means of a pressure roller 30 (represented by broken lines in FIG. 1). The lower clamping part 3 has a supporting face 9.1 located on a side facing the printing plate 10 which forms a bevelled continuation of the clamping face 8. As a result of the rotation of the actuating shaft 19 (beginning with the gap 9 open), the tension rail 1 is rotated into the position illustrated in FIG. 2. In other words, the printing plate 10 is introduced into the gap 9, whereupon the closing of the gap 10 or the clamping takes place (rotation of the clamping shaft 25). The tensioning of the printing plate 10 then takes place as a result of a reverse rotation of the actuating shaft 19, so that the tension rail 1 is pivoted back by the force of the compression spring 16 (in each portion 13) about the pins 23 into a third position. The release of the printing plate 10 takes place in a similar way in the opposite direction. The clamping is released, for example in the position illustrated in FIG. 3, and the tension rail 1 is then pivoted into the initial position shown in FIG. 1.

Figure 6:
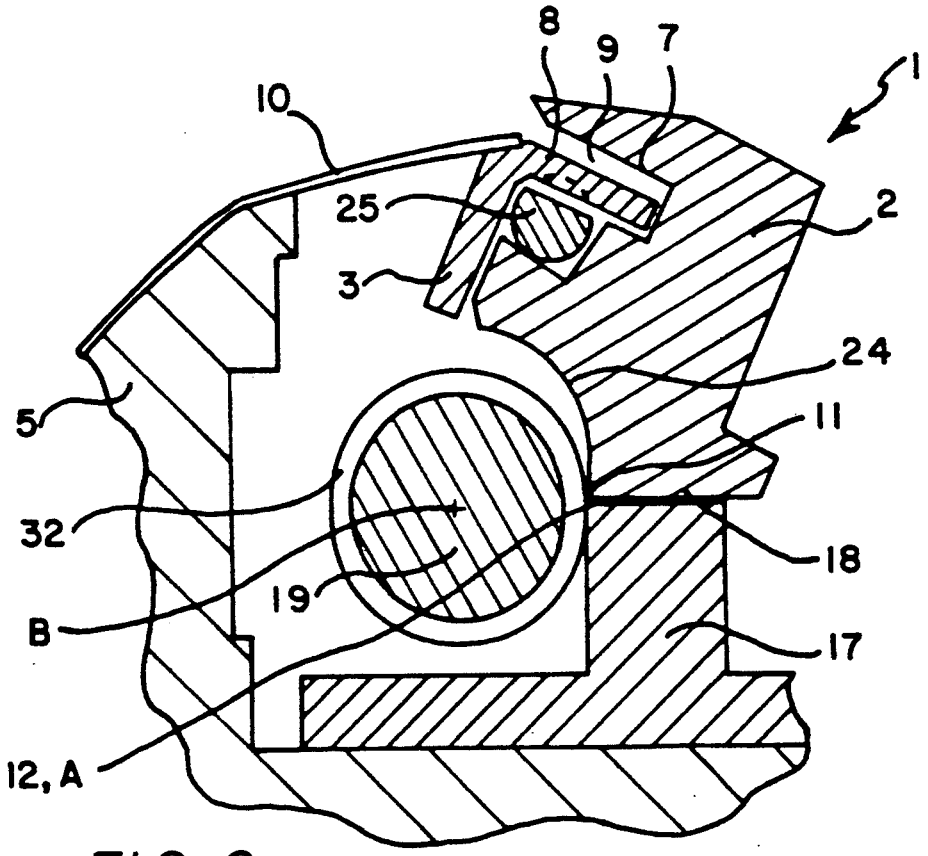
FIG. 6 is a cross-sectional view of a second embodiment of the tension rail shown in profile.
Figure 7:
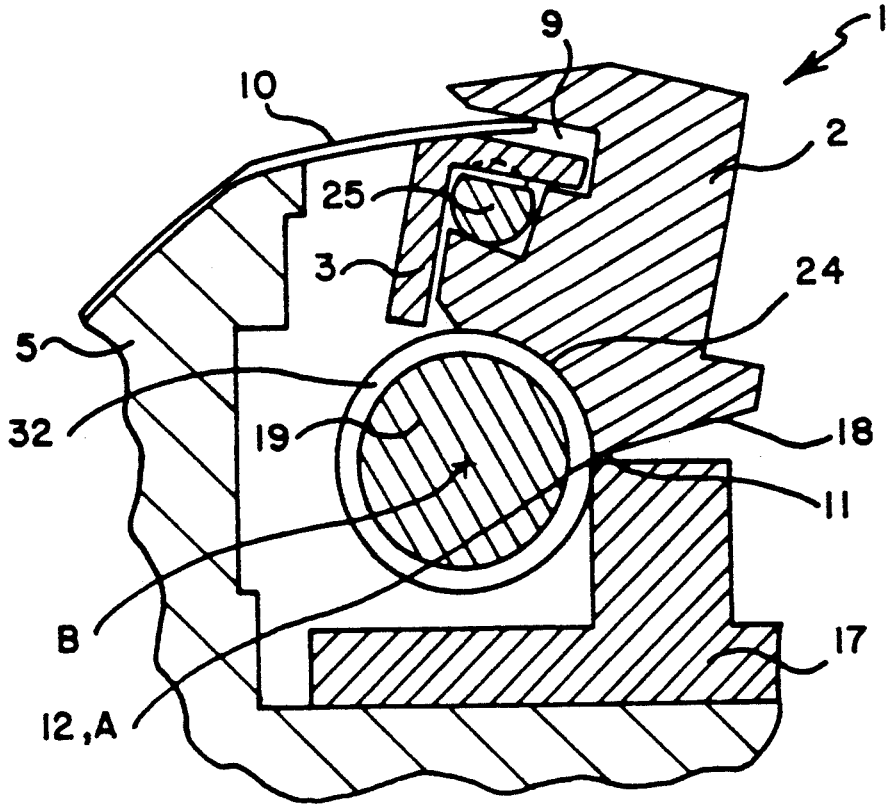
FIG. 7 is a partial cross-sectional view thereof showing the tension rail in a second position; and, FIG. 8 is a partial cross-sectional view thereof showing the tension rail in a third position.
Figure 8:
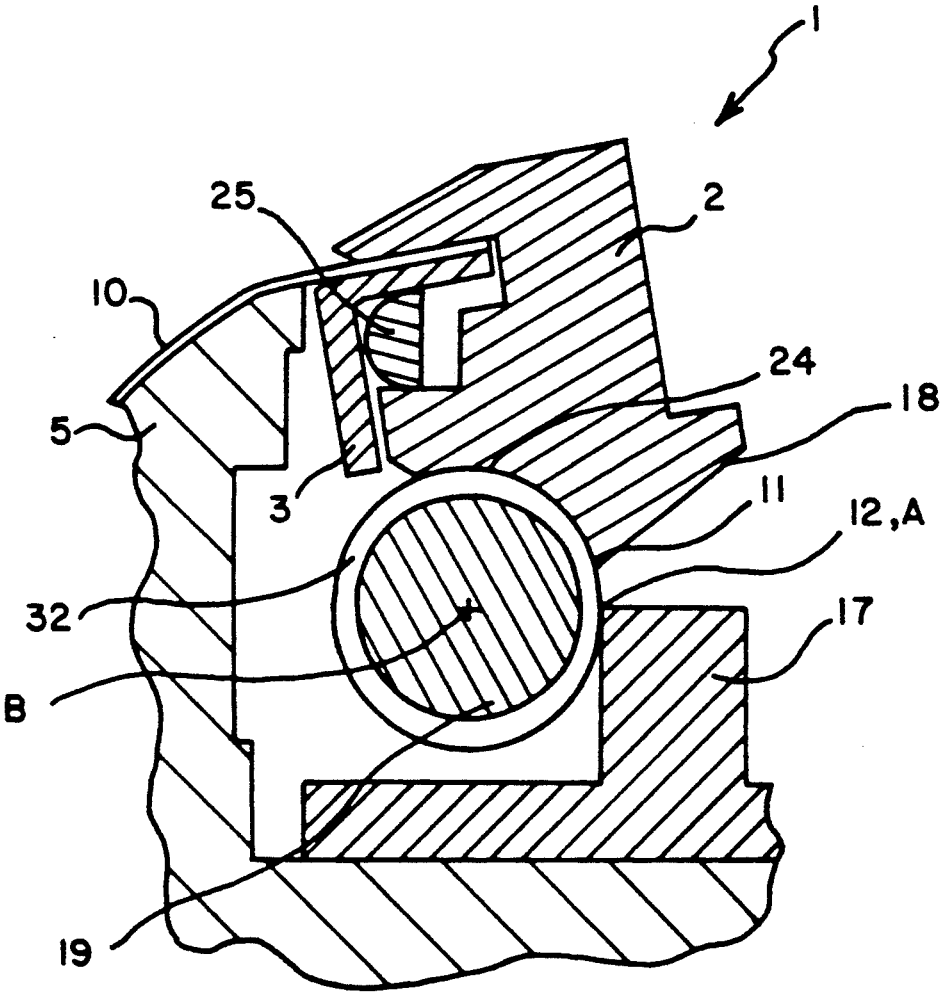

FIGS. 6, 7 and 8 illustrate a second embodiment of the tension rail 1 constructed in accordance with the invention. Here, the tension rail 1 is shown in profile in three pivoting positions. FIG. 6 corresponds to the completely open position; FIG. 8 illustrates the completely forward position; and, FIG. 7 shows the position in which a change of the pivot axes A, B takes place.

In this embodiment, the upper clamping part 2 once again includes an edge 11 formed on its underside. Furthermore, the upper clamping piece 2 is also supported on a stop 12 which is formed by the combination of a face fixed relative to the cylinder, (for example a face of a baseplate 17), and by the outer circumference of the actuating shaft 19 or of one or more bearings 32 (for example needle bearings) situated thereon. This stop 12, thus forms the pivot axis A. As in the first embodiment, a prestressed spring is preferably articulated on the upper clamping piece 2. (A spring is included for each portion 13 if the tension rail 1 is subdivided into portions). This spring draws the supporting face 18 of the upper clamping piece 2 against a face fixed relative to the cylinder which can be, for example, a face of the baseplate 17. The upper clamping part 2 thus assumes the position illustrated by FIG. 6 which corresponds to the completely open position of the tension rail 1. Although the spring means and their points of articulation are not illustrated in the drawings, they are constructed and employed in a similar way to those illustrated in connection with the first embodiment described above.

The upper clamping part 2 has the profile illustrated in FIG. 6, 7 and 8. As can be seen in these FIGURES, the upper clamping piece 2 includes an arcuate recess or contour 24 adjacent to its edge 11 which is designed to match the outer circumference of the actuating shaft 19 (or bearings 32 located thereon).

The upper clamping piece 2, that is to say the tension rail 1, can be pivoted around the pivot axis A (out of the completely open position shown in FIG. 6) by rotating the actuating shaft 19 via a driving arm. This pivoting will occur until the contour 24 comes to bear against the outer circumference of the actuating shaft 19 or the bearing or bearings 32 included on the shaft's outer circumference as shown in FIG. 7. The tension rail 1 can then be further pivoted such that the upper clamping part 2 is pivoted about the actuating shaft 19 which now forms the pivot axis B.

The edge 11 of the upper clamping part 2 thus disengages the stop 12 of the pivot axis A. Now, starting from the position shown in FIG. 7, the tension rail 1 pivots about the pivot axis B of the actuating shaft 19 into the completely pushed-forward position illustrated by FIG. 8. This completely pushed forward position can be defined by a mechanical stop (not shown) or by a path limitation of the actuating shaft 19.

As shown in FIGS. 6, 7 and 8, the lower clamping piece 3 has an L-shaped profile and is mounted relative to the upper clamping piece 2 in a similar way to the first embodiment. Here too, a clamping shaft 25 has a flattened side and is supported in the manner of an inclined plane on a face of the upper clamping part 2. The gap 9, which is formed between the upper and lower clamping parts 2 and 3 by the opposed clamping faces 7 and 8, is opened and closed by means of the clamp actuating means (in the preferred embodiment, clamping shaft 25) for both gripping and releasing the printing plate 10.

In the embodiment illustrated in FIGS. 6, 7 and 8, the tension rail 1 is also pivotable about two pivot axes A, B. Thus, in order to grip the printing plate 10, the gap 9 is first moved out of the completely open position (FIG. 6) by rotating the tension rail 1 about the pivot axis A (which has a large pivoting radius). Then, after the gap 9 has been closed, the tension rail is rotated about pivot axis B which has a smaller pivoting radius as illustrated in FIGS. 7 and 8. The tensioning of the printing plate 10 takes place, after the relieving of the actuating shaft 19, via the force of the articulated spring or springs, so that the tension rail 1 assumes a position between those shown in FIGS. 7 and 8 which is determined by forces.

In the last-described exemplary embodiment, the actuating shaft 19 can cause the tension rail 1 to pivot forwards via a driving arm which acts on a rear part of the upper clamping piece 2, for example in the region of the supporting face 18. However, the actuating shaft 19 can also, once again, be articulated on the upper clamping piece 2 via at least one lever arm and at least one strap (not shown).

In both exemplary embodiments, the pivot axis A is designed in the manner of a knife-edge joint and the pivot axis B as a rotary joint, this being considered as a preferred embodiment of the general idea of the invention.

We claim as our invention:

1. A device for clamping and tensioning a printing plate having a leading edge and a trailing edge onto a plate cylinder of a sheet-fed rotary printing press wherein said plate cylinder includes an elongated cylinder channel having a bottom, said elongated cylinder channel being disposed longitudinally in said plate cylinder for receiving and supporting said clamping and tensioning device, said clamping and tensioning device comprising, in combination, a clamping and tensioning rail disposed in said cylinder channel, said clamping and tensioning rail including upper and lower clamping parts having opposed clamping faces, clamp actuating means for relatively moving said upper and lower parts with respect to one another to open and close a gap between said opposed clamping faces for respectively receiving and gripping said trailing edge of said printing plate therein, means defining a first pivot axis for pivotally supporting said clamping and tensioning rail, said first pivot axis being disposed a substantial predetermined first distance from said gap, means defining a second pivot axis for pivotally supporting said clamping and tensioning rail, said second pivot axis being disposed a substantially smaller second distance than said predetermined first distance from said gap, and actuating means for pivoting said clamping and tensioning rail successively about said first and second pivot axes toward said trailing edge of said printing plate while said gap is open to receive said trailing edge therein and for pivoting said clamping and tensioning rail in the opposite direction about said second pivot axis after said trailing edge is gripped in said gap in order to tension said printing plate on said plate cylinder.

2. A clamping and tensioning device as defined in claim 1 wherein said first and second pivot axes are defined respectively by first and second stops disposed in fixed relation in said cylinder channel and said clamping and tensioning rail is formed with portions respectively engageable with said first and second stops.

3. A clamping and tensioning device as defined in claim 2 wherein said first stop defining said first pivot axis comprises a longitudinally extending step formed in said bottom of said cylinder channel and said clamping and tensioning rail is formed with a lower edge engageable with said stp for pivotally supporting said clamping and tensioning rail.

4. A clamping and tensioning device as defined in claim 3 wherein said second stop defining said second pivot axis comprises a longitudinally extending shaft secured in said cylinder channel and said clamping and tensioning rail is formed with an arcuate recess engageable with said shaft for pivotally supporting said clamping and tensioning rail wherein said lower edge and said arcuate recess are formed in said upper clamping part of said clamping and tensioning rail.

5. A clamping and tensioning device as defined in claim 2 wherein said stop comprising said first pivot axis is formed on a baseplate attached to said bottom of said cylinder channel.

6. A clamping and tensioning device as defined in claim 1 wherein said upper clamping part of said clamping and tensioning rail has a lower supporting face adapted to rest on said bottom of said cylinder channel and to support said clamping and tensioning rail in at least its fully open position.

7. A clamping and tensioning device as defined in claim 1 including prestressed spring means for biasing said clamping and tensioning rail into its fully open position wherein said actuating means is operative for pivoting said clamping and tensioning rail successively about said first and second pivot axes against the biasing force of said spring means.

8. A clamping and tensioning device as defined in claim 7 wherein said spring means includes a compression spring which is fixed relative to said plate cylinder at one end and which is articulated on said clamping and tensioning rail at the other end by a pull rod.

9. A clamping and tensioning device as defined in claim 7 wherein said upper and lower clamping parts of said clamping and tensioning rail are divided into a plurality of axial portions which are jointly pivotable about said first and second pivot axes via said actuating means.

10. A clamping and tensioning device as defined in claim 9 wherein each of said axial portions of said clamping and tensioning rail includes one of said prestressed spring means.

11. A clamping and tensioning device as defined in claim 9 including bearing plates disposed between adjacent ones of said axial portions of said clamping and tensioning rail wherein said bearing plates include stops comprising said second pivot axis.

12. A clamping and tensioning device as defined in claim 11 wherein said bearing plates disposed between adjacent ones of said axial portions of said clamping and tensioning rail are braced relative to one another by threaded spindles.

13. A clamping and tensioning device as defined in claim 1 wherein said actuating means for pivoting said clamping and tensioning rail includes an actuating shaft disposed parallel to the axis of said plate cylinder.

14. A clamping and tensioning device as defined in claim 13 wherein said actuating shaft comprises said second pivot axis disposed underneath said clamping and tensioning rail and said clamping and tensioning rail includes an arcuate recess engageable with said actuating means for pivotally supporting said clamping and tensioning rail.

15. A clamping and tensioning device as defined in claim 14 wherein said actuating shaft of said actuating means includes bearings on its outer circumference which interact with said arcuate recess of said clamping and tensioning rail.

16. A clamping and tensioning device as defined in claim 13 wherein said actuating shaft acts upon said clamping and tensioning rail via at least one lever arm and one strap.

17. A clamping and tensioning device as defined in claim 13 wherein said actuating shaft acts upon said clamping and tensioning rail via at least one driving arm.

18. A clamping and tensioning device as defined in claim 1 wherein said lower clamping part of said clamping and tensioning rail includes a supporting face comprising a bevel disposed adjacent said gap for guiding the introduction of said trailing edge of said printing plate into said gap.

* * * * *